US006736081B1

(12) United States Patent
Green et al.

(10) Patent No.: US 6,736,081 B1
(45) Date of Patent: May 18, 2004

(54) BILGE MANAGEMENT AND CONTROL SYSTEM OF A VESSEL

(76) Inventors: Lawrence M. Green, 12600 SW. 81st Ave., Pinecrest, FL (US) 33156; Betty Barber, 13531 SW. 101 La., Miami, FL (US) 33186

( * ) Notice: Subject to any disclaimer, the term of this patent is extended or adjusted under 35 U.S.C. 154(b) by 0 days.

(21) Appl. No.: 10/407,378

(22) Filed: Apr. 3, 2003

(51) Int. Cl.[7] ..... B63B 13/00
(52) U.S. Cl. ..... 114/183 R; 114/197
(58) Field of Search ..... 114/183 R, 185, 114/197, 198

(56) References Cited

U.S. PATENT DOCUMENTS 3,475,772 A * 11/1969 Lokken ..... 114/361
3,565,031 A * 2/1971 DePersia et al. ..... 114/185
5,722,339 A * 3/1998 Gross ..... 114/182
6,038,992 A * 3/2000 Smith ..... 114/183 R
6,357,376 B1 * 3/2002 Purio ..... 114/197
6,390,007 B1 * 5/2002 Walker ..... 114/183 R
6,477,971 B2 * 11/2002 Green ..... 114/197

* cited by examiner

*Primary Examiner*—Stephen Avila

(57) ABSTRACT

A bilge management and control system for a vessel having a full port through-transom threaded pipe fitting located near the lowest point of the interior of a vessel and ending in a flange mounted against the exterior transom wall, with the means for sealing the interior area of the transom from both sides, with hose barb to male plug adapters (or garden hose adapters) and/or solid threaded plugs threaded into one or both ends of the threaded through-transom pipe, at the entry point and at the exit terminus, such that substances may be prevented from entering a bilge, may be introduced into a bilge and/or forward compartments of a vessel, retained and controlled within a bilge and/or forward compartments of a vessel, or directed out of a bilge and/or forward compartments of a vessel by gravity flow, differential pressure or other mechanical means when the solid threaded plugs at one or both ends are removed or back-threaded to unseal the pipe wall's opposing ingress and egress portholes, if they are present, thus allowing ultimate management and control of the contents of a bilge.

9 Claims, 6 Drawing Sheets

BILGE MANAGEMENT AND CONTROL SYSTEM OF A VESSEL

CROSS-REFERENCE TO RELATED APPLICATIONS

"Not Applicable"

STATEMENT REGARDING FEDERALLY SPONSORED R & D

"Not Applicable"

REFERENCE TO SEQUENCE LISTING, A TABLE, OR A COMPUTER PROGRAM LISTING APPENDIX

"Not Applicable"

BACKGROUND OF THE INVENTION

The bilge management and control system of the present invention consists of a bilge drain assembly in two variations which overcome significant defects and deficiencies in both the prior art and established assembly designs widely employed by boat manufacturers. The basic design of the bilge drain assembly of this invention incorporates a specialized one-piece full port through-transom fitting with a hose barb to male plug adapter and solid threaded plug which thread into the fitting's pipe opening inside or outside of the bilge.

The prior art of the present invention established communication between a bilge and the exterior of a vessel through its transom using drain assemblies consisting of a garboard drain, a garboard drain and a pipe nipple (Green, U.S. Pat. No. 6,977,471) or a pipe nipple and a threaded cap or flange (DePersia, U.S. Pat. No. 3,565,031). The bilge drain holes of most pleasure craft are equipped with garboard drains, which remain the boating industry's standard. Garboard drain assemblies are installed in a vessel's bilge drain hole from the exterior of a vessel's transom and penetrate the transom only one-half inch of the way into its bilge drain hole. The remainder of the transom's interior around the bilge drain hole is exposed to substances which collect inside a bilge. These substances leach into the structural materials comprising the transom through the bilge drain hole, saturating and degrading them. It isn't unusual for the transom of a recreational vessel equipped with a garboard drain assembly to begin to experience degradation, expansion and rot upon exposure. The harmful effect of exposure that garboard drain assemblies cause in transoms from the inside is compounded by the set screws that anchor a garboard drain to the exterior transom wall. Set screws pierce the exterior transom wall where they are threaded in, without adequate precautions taken to seal the punctures they create. Moreover, the repetitive actions of threading the drain plug in to prepare a vessel for launch and unthreading the drain plug to drain the bilge after use, creates torque on the set screws, causing them to shear. Over time, seawater disintegrates the set screws and loosens the garboard drain in the bilge drain hole, allowing seawater to saturate and expand the transom from the exterior as well. For this reason, a bilge drain assembly having a pipe nipple which threads into the back end of a garboard drain and through the transom (Green) provides the transom less than adequate protection.

A pipe nipple which extends from inside the bilge through the transom and threads into a cap or flange mounted against the exterior transom wall affords no greater protection to the transom than a garboard drain assembly. This is particularly true in the case of prior art, where the manner of threading and the threading itself, existing between the exterior threaded cap or flange and the threaded end of the pipe nipple (DePersia), are inadequate to prevent seawater from leaching into the interior structure of the transom The present invention overcomes these design deficiencies and defects by incorporating a specialized one-piece full port through-transom fitting having a threaded pipe that extends from its flanged end, mounted against the exterior transom wall, all the way through the transom's bilge drain hole into the bilge. The full port through-transom fitting of this invention protects the structural integrity of the transom around the bilge drain hole in which it resides from both sides. Outside the vessel, the transom is protected by the underside of the fitting's flanged end, which is cast with a sealing bead to which is applied a waterproof sealant. The sealant prevents the saturation of transom exposed by the bilge drain hole. In addition, the full port through-transom fitting requires no set screws to hold it in place; it is drawn against the exterior transom wall by a flanged locking nut which threads down on the fitting's pipe inside the bilge. Inside the bilge, the transom is protected by three components threaded over the fitting's pipe: a compressible washer followed by a metal washer and the flanged locking nut. The compressible washer is malleable and fills voids that may exist in the surface of the interior transom wall. Although the full port through-transom fitting is threaded into the bilge drain hole that is drilled out to accommodate it, the compressible washer affords the extra protection necessary to seal the interior transom wall around the bilge drain hole. The compressible washer is made of a non-reactive material capable of withstanding the substances encountered in a bilge or forward compartment of a vessel. The metal washer serves to protect the compressible washer in two different ways. First, it minimizes the compressible washer's exposure to substances which may be present in bilge waters. Second, it prevents the compressible washer from twisting out of place or becoming frayed or tom when it is installed by pressing the compressible washer evenly against the interior transom wall as the flanged locking nut tightens down on both washers on the through-transom fitting's pipe. This is something DePersia failed to do when he constructed an O-ring lying between a pipe nipple protruding through the exterior transom wall and a threaded cap or flange, which is, in reality, nothing more than a flanged locking nut.

Another disadvantage of having a garboard drain assembly installed in a vessel's transom concerns the solid plug that threads into the exterior face of the garboard drain outside the vessel. Following launch, the plug is submerged and cannot be reached unless someone gets into the water. It is a common occurrence for a boater to forget to thread in a plug before launch or to lose a plug after launch. However, it is often the case that when events overtake and a boater has every reason to get into the water to thread in or thread out a plug, that option is as dangerous as remaining in the vessel. An exterior plug also can be a formidable nuisance after launch, catching on lines, wood and other solid materials floating about, which can loosen the sparse threading or otherwise cause damage to the garboard drain plug.

The bilge drain assembly of this invention overcomes these disadvantages by permitting the threading of a solid threaded plug into the entry point of the full port through-transom fitting's pipe inside the bilge. Threading and unthreading a solid threaded plug from the pipe's entry point allows a boater to control the contents of a bilge from inside the vessel. In an alternate version of the bilge drain assembly, the full port through-transom fitting has two opposing ingress and egress portholes in its pipe wall. The portholes allow bilge waters and other substances to enter the unobstructed straight-through interior passageway of the fitting's pipe aft of the solid threaded plug without unthreading the plug. In this version, the solid threaded plug can be back-threaded by manual operation or by remote actuation to unseal the opposing ingress and egress portholes. In both versions of the present invention, with or without portholes, no ball valve (stopcock) is required to prevent seawater from entering the bilge or otherwise manage its content (Green); the solid threaded plug creates the watertight seal required when properly threaded into the entry point of the through-transom fitting.

The bilge drain assembly of this invention is distinguishable from the prior art in another aspect of its specialization. The full port through-transom fitting's pipe is threaded internally and externally to permit the threading in of hose barb to male plug adapters into one and both ends of the fitting. This configuration permits a boater or another operator to use the bilge drain assembly of this invention as a conduit for controlling bilge waters and other substances which ultimately collect in a bilge, and those that typically don't, such as engine room spills and overflows, in a way that is useful and new. When the full port through-transom fitting is coupled with hose barb to male plug adapters at each end, the bilge management and control system of this invention enables almost any boater or other operator to comply with federal, state and local environmental regulations governing unlawful discharges with minimal effort and expense. The Refuse Act of 1899 prohibits throwing, discharging or depositing any refuse matter of any kind (including trash, garbage, oil and other liquid pollutants) into the waters of the United States. 33 U.S.C. 407. The Federal Water Pollution Control Act prohibits the discharge of oil or oily waste upon or into any navigable waters of the United States. The prohibition includes any discharge which causes a film or discoloration of the surface of the water or causes a sludge or emulsion beneath the surface of the water. Violators are subject to civil and/or criminal sanctions including fines and imprisonment. (79 Stat. 903) as amended, 33 U.S.C. 1251 et seq.

Extraction of the kinds of pollutants contemplated by these environmental regulations, such as fuel, oils and solvents, is managed by attaching hosing or tubing to the hose barb ends of the hose barb to male plug adapters which are threaded into the entry point and exit terminus of the full port through-transom fitting. A bilge and/or a forward compartment of a vessel may be drained of its liquid contents by siphoning or pumping them through the components of the bilge drain assembly of this invention into a barrel, tank or any other receptacle. The advantages to doing this are obvious. First, a boater or another operator can by-pass the bilge pump(s) that otherwise would have to be employed to evacuate these hazardous substances. Second, remote extraction allows the above-described operations to conform to O.S.H.A. standards intended to reduce worker exposure to hazardous and toxic chemicals. Third, the bilge management and control system of this invention creates an incentive for a boater to demonstrate responsible stewardship over the environment in the preservation of water quality by allowing him/her to control the time, place and manner of extraction, with the result that the boater, another operator or a waste hauler could be engaged to extract and/or remove the hazardous contents of a bilge or forward compartment when a vessel is dry docked for routine maintenance, repair or storage. This is every reason why a vessel that has a bilge drain hole should be retro-fitted with the bilge management and control system of this invention and it is every reason why a vessel that has no bilge drain hole in its transom should have one.

BRIEF SUMMARY OF THE INVENTION

The bilge management and control system of this invention employs a full port through-transom fitting located near the lowest point of the interior of a vessel and ending in a flange mounted against the exterior transom wall, with the means for sealing the interior area of the transom from both sides, with hose barb to male plug adapters (or garden hose adapters) and/or solid threaded plugs threaded into one or both ends of the threaded through-transom pipe, at the entry point and at the exit terminus. The hose barb to male plug adapters provide a contiguous unobstructed straight-through interior passageway by which to extend the efficacy of the full port through-transom fitting in both directions: beyond its exit terminus by means of flexible tubing or hoses into a receptacle and beyond the bilge by means of flexible tubing or hoses into a vessel's forward compartments. Solid threaded plugs achieve a watertight seal when threaded into the hose barb end of the hose barb to male plug adapters at each end of the full port through-transom fitting or directly into the entry point or exit terminus of the full port through-transom fitting.

The function of this invention is to permit a vessel operator to control the contents of the bilge and/or the forward compartments of a vessel primarily from inside the vessel. This invention is designed to prevent seawater or other substances from entering a bilge, to retain and control substances within a bilge and/or the forward compartments of a vessel, to introduce substances into a bilge and/or the forward compartments of a vessel, and to direct the flow of substances out of a bilge and/or the forward compartments of a vessel, by gravity flow, differential pressure or other mechanical means, thus achieving ultimate management and control over the contents of a bilge and/or the forward compartments of a vessel. In addition, the full port through-transom fitting of this invention protects the structural integrity of the transom in which it resides from both sides.

DETAILED DESCRIPTION OF THE INVENTION

Figure 1:
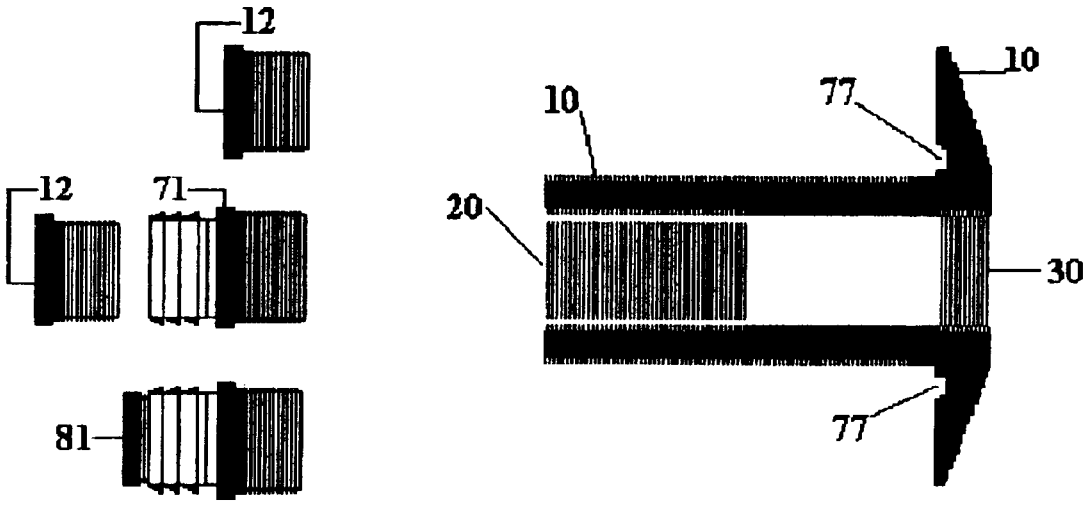
FIG. 1 is a sectional side view of the full port through-transom fitting, threaded internally and externally, hose barb to male plug adapter and solid threaded plug to achieve a watertight seal, for manual operation.

FIG. 1 is a sectional side view of the full port through-transom fitting (10). The full port through-transom fitting's pipe is threaded internally and externally. The flanged end of the fitting, existing concurrent with the exit terminus (30), rests firmly against the exterior transom wall. The underside of the flange has a sealing bead (77) encircling it near the aperture in the transom wall receiving the full port through-transom fitting's pipe. A hose barb to male plug adapter (71) may be threaded into the entry point (20) of the full port through-transom fitting (10), providing a contiguous unobstructed straight-through interior passageway by which to extend the efficacy of the full port through-transom fitting (10) beyond the bilge into a vessel's forward compartments. A solid threaded plug having a headcap (12) achieves a watertight seal when it is threaded into the hose barb end of the hose barb to male plug adapter (81) or directly into the entry point (20) of the full port through-transom fitting (12), preventing seawater and other substances from entering a bilge and allowing bilge waters and other substances to be retained and controlled within a bilge and/or the forward compartments of a vessel.

Figure 2:
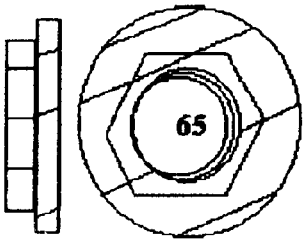
FIG. 2 is a side view and frontal view of the flanged locking nut.

FIG. 2 is a side view and frontal view of a flanged locking nut (65).

Figure 3:
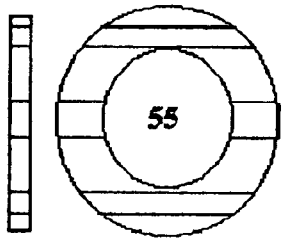
FIG. 3 is a side view and frontal view of the metal washer.

FIG. 3 is a side view and frontal view of a metal washer (55) of a material capable of enduring the elements encountered in a bilge or the forward compartments of a vessel.

Figure 4:
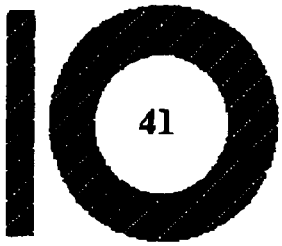
FIG. 4 is a side view and frontal view of the compressible washer.

FIG. 4 is a side view and frontal view of a compressible washer (41) of a non-reactive material capable of enduring the elements encountered in a bilge or the forward compartments of a vessel and malleable to fill voids that may exist in the surface of the interior transom wall.

Figure 5:
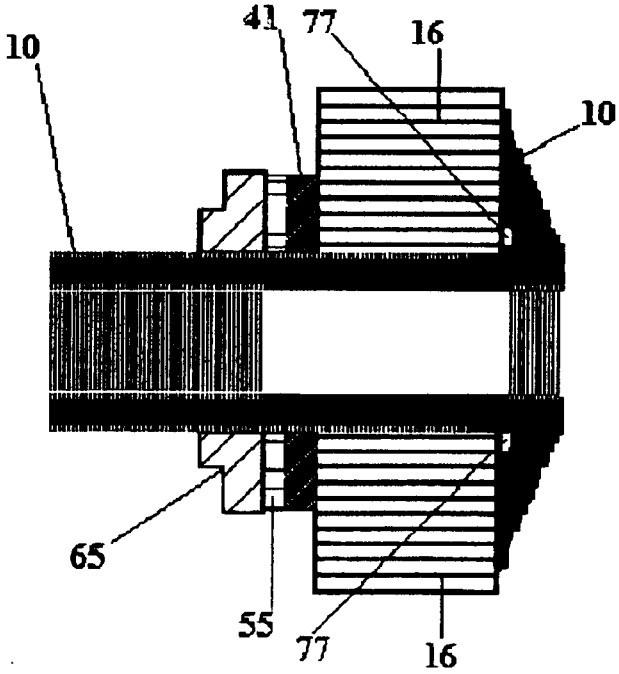
FIG. 5 is a sectional side view of the full port through-transom fitting, threaded internally and externally, with a compressible washer followed by a metal washer secured against the interior transom wall by a flanged locking nut threaded down on the fitting's pipe. The flanged locking nut also serves to draw the flanged end of the full port through-transom fitting's pipe firmly against the exterior transom wall.

FIG. 5 is a sectional side view of the full port through-transom fitting (10), threaded through the transom of a vessel (16). A compressible washer (41) is fitted over the full port through-transom fitting's pipe and secured between the interior transom wall (16) and a metal washer (55) by a flanged locking nut (65) which threads down against the metal washer (55) and compressible washer (41) on the fitting's pipe. The compressible washer (41) is compressed against the interior transom wall around the aperture through which the full port through-transom fitting's pipe extends into the bilge, preventing bilge waters and other substances in a bilge from saturating, leaching and otherwise degrading the interior area of the transom around the aperture in the otherwise unprotected transom wall.

Additionally, the flanged locking nut (65) draws the flanged end of the full port through-transom fitting's pipe against the exterior transom wall A sealing agent is applied liberally to the scaling bead (77) on the underside of the flange. As the flanged end of the full port through-transom fitting draws against the exterior transom wall of a vessel it seals the aperture through which the full port through-transom fitting's pipe (10) extends into the bilge, preventing seawater or other substances outside a vessel from saturating, leaching and otherwise degrading the interior area of the transom around the aperture in the otherwise unprotected transom wall under the flanged end of the full port through-transom fitting.

Figure 6:
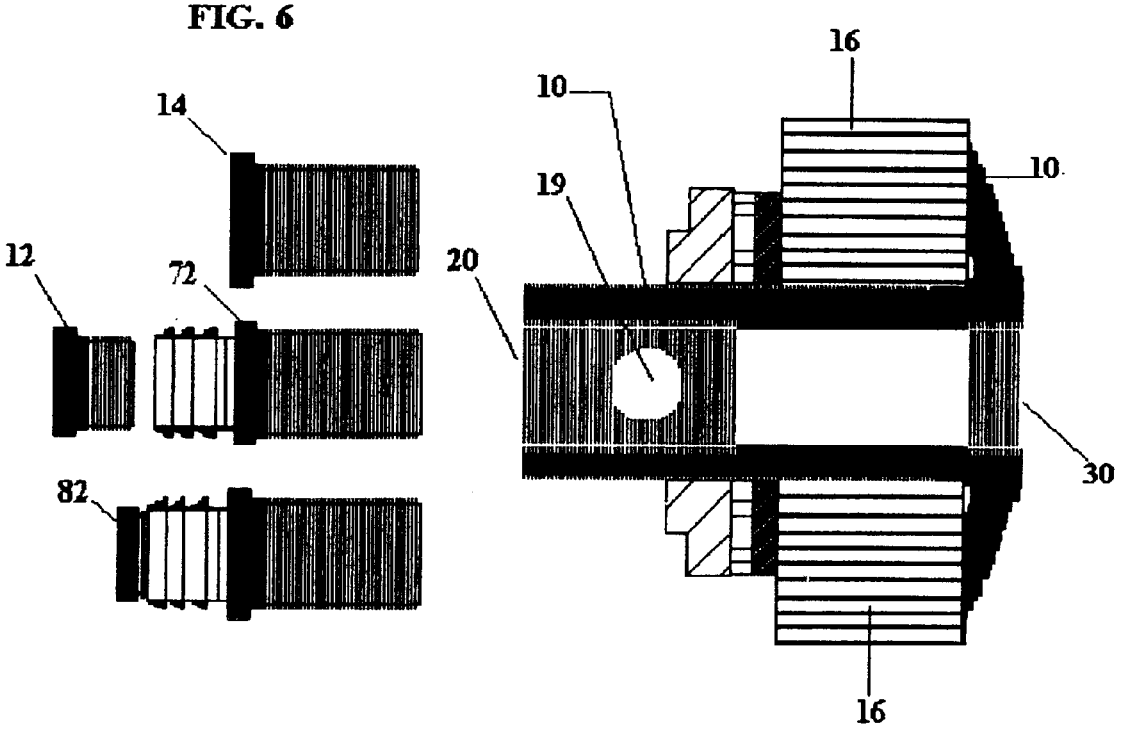
FIG. 6 is a sectional side view of the full port through-transom fitting, threaded internally and externally, having two opposing ingress and egress portholes in its pipe wall for manual operation or remote actuation, a proportionally threaded hose barb to male plug adapter and solid threaded plug to achieve a watertight seal.

FIG. 6 is a sectional side view of the full port through-transom fitting (10), threaded through the transom of a vessel (16). The full port through-transom fitting's pipe is threaded internally and externally, with two opposing ingress and egress portholes in its pipe wall (19) for manual operation or remote actuation. A proportionally threaded hose barb to male plug adapter (72) may be threaded into the entry point (20) of the full port through-transom fitting (10), providing a contiguous unobstructed straight-through interior passageway to the exit terminus (30) by which to extend the efficacy of the full port through-transom fitting (10) beyond the bilge into a vessel's forward compartments. A proportionally threaded solid threaded plug having a headcap (12) achieves a watertight seal when it is threaded into the hose barb end of the hose barb to male plug adapter (82) or directly into the entry point (20) of the full port through-transom fitting (14), preventing seawater or other substances from entering a bilge and allowing bilge waters or other substances to be retained and controlled within a bilge and/or the forward compartments of a vessel.

Figure 7:
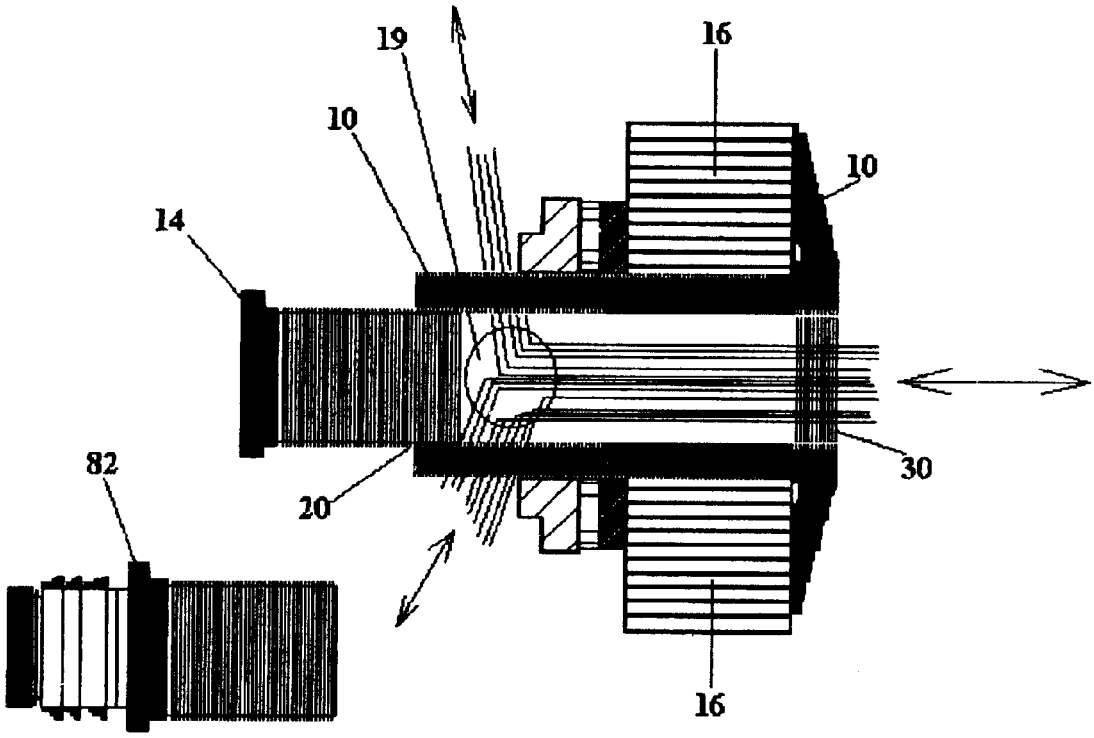
FIG. 7 is a sectional side view of the full port through-transom fitting, threaded internally and externally, having two opposing ingress and egress portholes in its pipe wall for manual operation or remote actuation, a proportionally threaded hose barb to male plug adapter, back-threaded, and solid threaded plug to achieve a watertight seal

FIG. 7 is a sectional side view of the full port through-transom fitting (10), threaded through the transom of a vessel (16). The full port through-transom fitting's pipe is threaded internally and externally, with two opposing ingress and egress portholes in its pipe wall (19) for manual operation or remote actuation. The opposing ingress and egress portholes in the fill port through-transom fitting's pipe (19) permit bilge waters or other substances to enter the fitting's pipe through the portholes and be discharged from the pipe's exit terminus (30) when the proportionately threaded solid threaded plug having a headcap (14) or proportionally threaded hose barb to male plug adapter (82) threaded into the entry point (20) of the full port through-transom fitting (10) are back-threaded, manually or by remote actuation, to unseal the portholes in the pipe wall. Likewise, substances may be introduced into a bilge and/or the forward compartments of a vessel by the same means.

Figure 8:
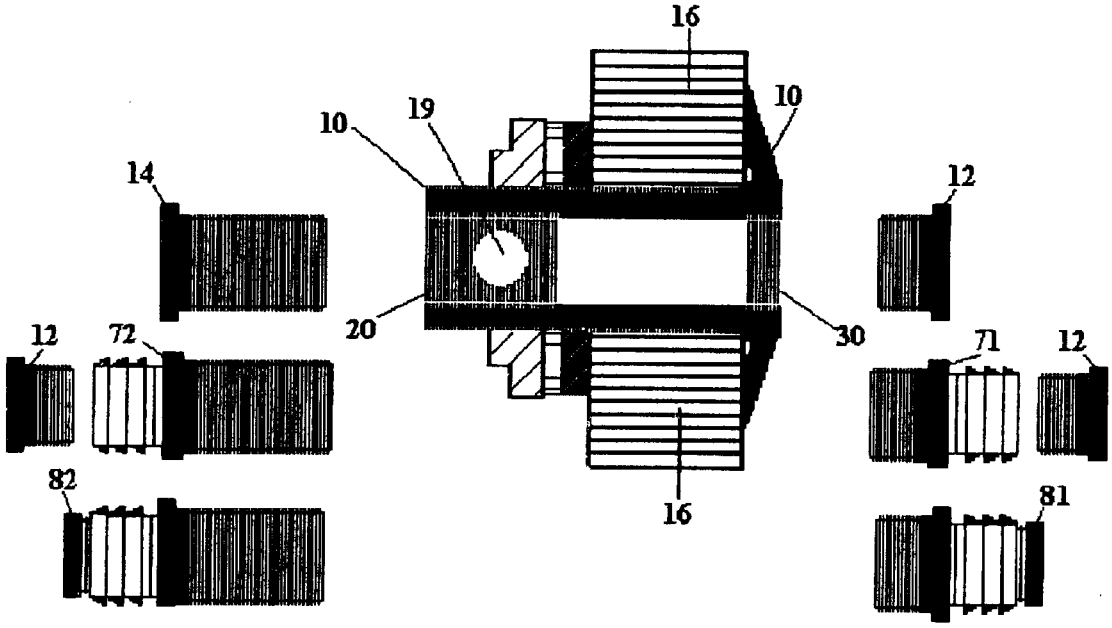
FIG. 8 is a sectional side view of the full port through-transom fitting, threaded internally and externally, having two opposing ingress and egress portholes in its pipe wall for manual operation or remote actuation, and proportionally threaded hose barb to male plug adapters and solid threaded plugs to achieve watertight seals at the fitting's entry point and exit terminus.

FIG. 8 is a sectional side view of the full port through-transom fitting (10), threaded through the transom of a vessel (16). The full port through-transom fitting's pipe is threaded internally and externally, with two opposing ingress and egress portholes in its pipe wall (19) for manual operation and remote actuation. A proportionally threaded hose barb to male plug adapter may be threaded into the entry point (20) of the full port through-transom fitting (72) or into the exit terminus (30) of the full port through-transom fitting (71), or into both ends of the fitting's pipe simultaneously, providing a contiguous unobstructed straight-through interior passageway by which to extend the efficacy of the full port through-transom fitting (10) beyond the bilge into a vessel's forward compartments. A proportionally threaded solid threaded plug having a headcap (12) achieves a watertight seal when it is threaded into the hose barb end of the hose barb to male plug adapter (72) threaded into the entry point (20) of the fitting's pipe (82), or into the hose barb end of the hose barb to male plug adapter (71) threaded into the exit terminus (30) of the fitting's pipe (81). The threading into position of either proportional solid threaded plug having a headcap, (12) or (14), prevents seawater or other substances from entering a bilge and allows bilge waters or other substances to be retained and controlled within a bilge and/or the forward compartments of a vessel.

The opposing ingress and egress portholes in the full port through-transom fitting's pipe (19) permit bilge waters and other substances to enter the fitting's pipe and be discharged from the hose barb to male plug adapter (71) threaded into the pipe's exit terminus (30), when the proportionately threaded solid threaded plug having a headcap (14) or the plugged, proportionately threaded hose barb to male plug adapter (82) threaded into the entry point (20) of the full port through-transom fitting (10) are back-threaded manually or by remote actuation to unseal the portholes in the pipe wall. Likewise, substances may be introduced into a bilge and/or the forward compartments of a vessel through the hose barb to male plug adapter (71) threaded into the exit terminus (30) of the full port through-transom fitting's pipe by the same means.

Figure 9:
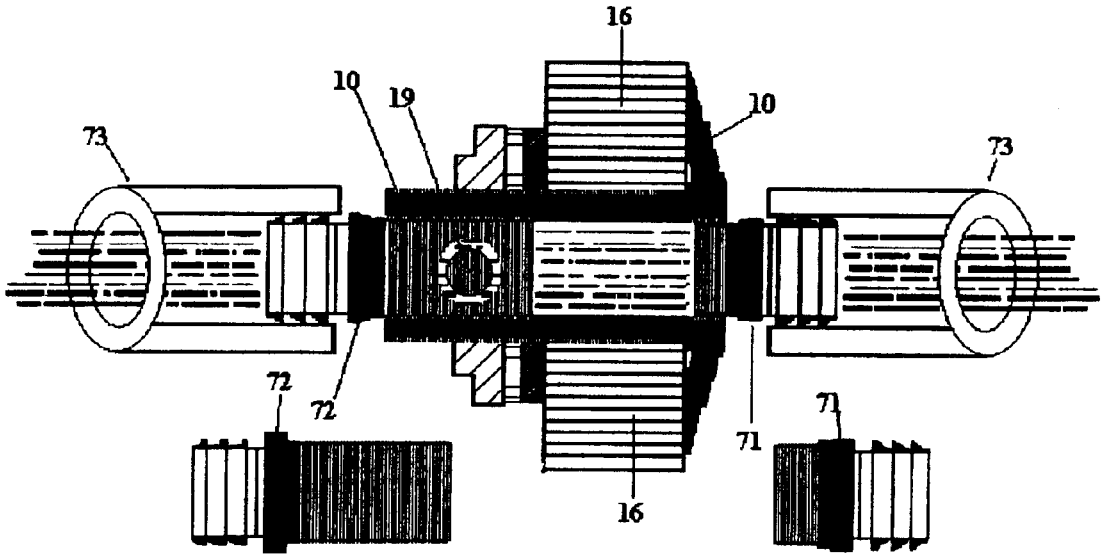
FIG. 9 is a sectional side view of the full port through-transom fitting, threaded internally and externally, having two opposing ingress and egress portholes in its pipe wall for manual operation and remote actuation, and proportionally threaded hose barb to male plug adapters followed at each end by flexible tubing or hoses.

FIG. 9 is a sectional side view of a bilge management and control system of a vessel: a full port through-transom fitting (10), threaded internally and externally, having two opposing ingress and egress portholes in its pipe wall (19) for manual operation and remote actuation, proportionally threaded hose barb to male plug adapters at the fitting pipe's entry point (72) and exit terminus (71), followed at each end by flexible tubing or hoses (73). The bilge management and control system of this invention allows for the containment and/or directed flow of substances in either direction, into or out of a bilge, while protecting the structural integrity of the transom in which it resides from both sides.

The addition of a proportionally threaded hose barb to male plug adapter (72) threaded into the entry point (20) of the full port through-transom fitting (10) provides a contiguous unobstructed straight-through interior passageway by which to extend the efficacy of the full port through-transom fitting (10) beyond a bilge into a vessel's forward compartments by means of flexible tubing or hoses (73) connected to the hose barb end. This configuration of the invention allows substances to be drained or siphoned out of a bilge and/or forward compartments of a vessel by gravity flow, differential pressure or other mechanical means.

The addition of a proportionally threaded hose barb to male plug adapter (71) threaded into the exit terminus (30) of the fill port through-transom fitting (10) provides a contiguous unobstructed straight-through interior passageway by which to extend the efficacy of the full port through-transom fitting (10) beyond its exit terminus by means of flexible tubing or hoses (73) connected to the hose barb end. This configuration of the invention allows substances to be directed out of a bilge and/or forward compartments of a vessel by gravity flow, differential pressure or other mechanical means into a receptacle. It also allows for the introduction of substances into a bilge and/or the forward compartments of a vessel.

The above-described configurations of the full port through-transom fitting (10), using proportionally threaded hose barb to male plug adapters threaded into the entry point of the fitting's pipe (72), and/or its exit terminus (71), together with proportionally threaded solid threaded plugs having a headcap, (12) and/or (14), provide the means by which seawater or other substances may be prevented from entering a bilge; provide the means by which substance may be introduced into a bilge and/or the forward compartments of a vessel; provide the means by which bilge waters or other substances may be retained and controlled within a bilge and/or the forward compartments of a vessel; and provide the means by which bilge waters or other substances may be directed out of a bilge and/or the forward compartments of a vessel into a receptacle by gravity flow, differential pressure or other mechanical means, thus allowing ultimate management and control of the contents of a bilge.

We claim:

1. A bilge management and control system of a vessel comprising:

a full port through-transom fitting, a hose barb to male plug adapter (or a garden hose adapter) and/or a solid threaded plug;

said full port through-transom fitting consisting of a pipe having a flanged end;

said pipe being threaded inside and outside and providing a single unobstructed straight-through interior passageway, an entry point and an exit terminus, and being located near the lowest point of the interior of a vessel and extending into a bilge through an aperture in the lower portion of said transom wall of a vessel;

said flanged end mounted against the exterior surface of said transom wall near its lowest point;

said exit terminus of said pipe existing concurrent with said externally-mounted flanged end;

said hose barb to male plug adapter being threaded by its male plug adapter end into said pipe's entry point, forming a contiguous unobstructed straight-through interior passageway with said pipe;

said solid threaded plug being threaded into said hose barb to male plug adapter at its hose barb end or directly into said pipe's entry point, forming a watertight seal with said hose barb to male plug adapter and said pipe or with said pipe alone, such that said solid threaded plug dams said hose barb to male plug adapter and/or said pipe's unobstructed straight-through interior passageway, thus preventing seawater or other substances from entering a bilge and allowing bilge waters or other substances to be retained and controlled within a bilge and/or the forward compartments of a vessel or to be drained from a bilge and/or the forward compartments of a vessel into said hose barb to male plug adapter and/or said pipe's unobstructed straight-through interior passageway and through said exit terminus by gravity flow, differential pressure or other mechanical means when said solid threaded plug is removed.

2. The bilge drainage system of a vessel of claim 1 further securing said flanged end of said full port through-transom fitting against said exterior transom wall around said aperture in the lower portion of said transom wall by means of threading a flanged locking nut over the full port through-transom fitting's pipe toward the interior transom wall and drawing said flanged end of said full port through-transom fitting against said exterior transom wall such that seawater or other substances outside a vessel will not leach into said interior area of said transom from under said flanged end of said full port through-transom fitting and around said aperture in the lower portion of said transom wall and saturate and otherwise degrade said interior area of said otherwise unprotected transom.

3. The bilge drainage system of a vessel of claim 2 further sealing the interior area of said transom around said aperture in the lower portion of said transom wall by means of a compressible washer followed by a metal washer tightened against said interior transom wall on said full port through-transom fitting's pipe by means of said flanged locking nut such that bilge waters or other substances in the interior of a bilge will not leach into said interior area of said transom around said aperture in the lower portion of said transom wall and saturate and otherwise degrade said interior of said otherwise unprotected transom.

4. The bilge drainage system of a vessel of claim 3 in which said solid threaded plug has a head cap for manual operation.

5. The bilge drainage system of a vessel of claim 3 in which said full port through-transom fitting has two opposing portholes in its pipe wall, both portholes being ingress and egress portholes, such that when said threaded end of said hose barb to male plug adapter (or any garden hose adapter) or said solid threaded plug is threaded past said ingress and egress portholes, said threaded male plug adapter or said solid threaded plug dams said pipe's unobstructed straight-through interior passageway, thus preventing seawater or other substances from entering a bilge and allowing bilge waters or other substances to be retained and controlled within a bilge and/or the forward compartments of a vessel or to be drained from a bilge and/or the forward compartments of a vessel into said hose barb to male plug adapter and/or said pipe's unobstructed straight-through interior passageway and through said exit terminus by gravity flow, differential pressure or other mechanical means when said hose barb to male plug adapter or said solid threaded plug is back-threaded, unsealing said pipe wall's opposing ingress and egress portholes.

6. The bilge drainage system of a vessel of claim 5 in which said solid threaded plug has a head cap for manual operation.

7. The bilge drainage system of a vessel of claim 5 in which said solid threaded plug has a head cap for manual operation and/or remote actuation.

8. The bilge drainage system of a vessel of claim 5 in which said hose barb to male plug adapter (or any garden hose adapter) and/or said solid threaded plug are adapted to and threaded into said exit terminus existing concurrent with said externally-mounted flanged end of said pipe, such that bilge waters or other substances may be retained and controlled within a bilge and/or the forward compartments of a vessel or drained or siphoned from a bilge and/or the forward compartments of a vessel into said pipe's unobstructed straight-through interior passageway and exit terminus, through said hose barb to male plug adapter's hose barb end, by gravity flow, differential pressure or other mechanical means when said solid threaded plug is removed or back-threaded, unsealing said pipe wall's opposing ingress and egress portholes, if they are present.

9. The bilge drainage system of a vessel of claim 8 in which said hose barb to male plug adapter (or any garden hose adapter) and/or said solid threaded plug are adapted to and threaded into one or both ends of said full port through-transom fitting's pipe, said entry point and exit terminus, and through said hose barb to male plug adapter's hose barb end or ends and tubing or horses, into a receptacle, providing the means to retain and/or direct the flow of substances into or out of a bilge and/or the forward compartments of a vessel by gravity flow, differential pressure or other mechanical means when said solid threaded plugs at one or both ends are removed or are back-threaded, unsealing said pipe wall's opposing ingress and egress portholes, if they are present, thus achieving ultimate management and control over the contents of a bilge and/or the forward compartments of said vessel.

* * * * *